US011014321B2

(12) United States Patent
Klaer et al.

(10) Patent No.: US 11,014,321 B2
(45) Date of Patent: May 25, 2021

(54) ROTARY PRESS HAVING RAMS WITH AT LEAST TWO HEIGHT-STAGGERED RAM TIPS FOR CARRYING OUT A PLURALITY OF PRESSING OPERATIONS DURING A ROTATION

(71) Applicant: KORSCH AG, Berlin (DE)

(72) Inventors: Ingo Klaer, Berlin (DE); Thomas Weissbach, Berlin (DE); Stephan Mies, Berlin (DE)

(73) Assignee: KORSCH AG, Berlin (DE)

( * ) Notice: Subject to any disclaimer, the term of this patent is extended or adjusted under 35 U.S.C. 154(b) by 317 days.

(21) Appl. No.: 16/087,518

(22) PCT Filed: Mar. 24, 2017

(86) PCT No.: PCT/EP2017/057043
§ 371 (c)(1),
(2) Date: Sep. 21, 2018

(87) PCT Pub. No.: WO2017/162848
PCT Pub. Date: Sep. 28, 2017

(65) Prior Publication Data

US 2019/0099972 A1 Apr. 4, 2019

(30) Foreign Application Priority Data

Mar. 24, 2016 (DE) ..... 10 2016 105 588.3
Jun. 15, 2016 (EP) ..... 16174530

(51) Int. Cl.
*B30B 11/34* (2006.01)
*B30B 11/08* (2006.01)
*B30B 15/06* (2006.01)
*B30B 15/32* (2006.01)
*A61J 3/10* (2006.01)
*B30B 15/00* (2006.01)

(52) U.S. Cl.
CPC ..... *B30B 11/085* (2013.01); *A61J 3/10* (2013.01); *B30B 11/08* (2013.01); *B30B 11/34* (2013.01); *B30B 15/0023* (2013.01); *B30B 15/065* (2013.01); *B30B 15/32* (2013.01)

(58) Field of Classification Search
CPC ..... B30B 11/085; B30B 11/08; B30B 11/34; B30B 15/0023; B30B 15/065; B30B 15/32; A61J 3/10
See application file for complete search history.

(56) References Cited

U.S. PATENT DOCUMENTS 5,460,827 A * 10/1995 Sanderson ..... A61J 3/10 264/113

FOREIGN PATENT DOCUMENTS

JP 2003210553 A * 11/2002 ..... A61J 3/10

* cited by examiner

*Primary Examiner* — Matthew J Daniels
*Assistant Examiner* — Shibin Liang
(74) *Attorney, Agent, or Firm* — FisherBroyles, LLP

(57) ABSTRACT

The invention relates to a rotary press having height-staggered ram tips for carrying out at least two pressing operations, which preferably build on one another. Furthermore, the invention relates particularly to rotary presses and methods for producing multi-layer and coating-core tablets and for pressing tablets into cups during a rotation.

20 Claims, 9 Drawing Sheets

1. Coating-core tablet

2. Three-layer tablet

3. Two separate tablets

4. Pressing tablets into cups

ROTARY PRESS HAVING RAMS WITH AT LEAST TWO HEIGHT-STAGGERED RAM TIPS FOR CARRYING OUT A PLURALITY OF PRESSING OPERATIONS DURING A ROTATION

PRIORITY APPLICATIONS

This application is a U. S. National Stage Filing under 35 U.S.C. 371 from International Application No. PCT/EP2017/057043, filed on 24 Mar. 2017 and published as WO 2017/162848 on 28 Sep. 2017, which claims the benefit of priority to German Patent Application No. 10 2016 105 588.3, filed 23 Mar. 2016, and European Patent Application No. 16174530.2, filed 15 Jun. 2016, which applications and publication are incorporated herein by referenced in their entirety.

DESCRIPTION

The invention relates to a rotary press having rams with at least two height-staggered ram tips for carrying out at least two height-staggered pressing operations, which preferably build on one another. Furthermore, the invention relates particularly to rotary presses and methods for producing multi-layer and coat-core tablets and for pressing tablets into cups during a rotation.

BACKGROUND AND PRIOR ART

The invention relates to the field of rotary presses, which are used in the pharmaceutical, technical, or chemical industries or in the food industry to produce large numbers of tablets or pellets from powdery materials. Such rotary presses are known, for example, from patent specifications DE 102 12959 A1 or DE 202 20 440 U1.

In the known prior art, rotary presses preferably perform one pressing operation during one rotation to produce one type of tablets or pellets. Known rotary tablet presses include a top and a bottom ram, which interact to compress the powdery material in die cavities of a die table. A large number of applications, however require carrying out of different pressing operations sequentially one after the other, particularly to produce pellets from multiple components.

For example, rotary presses are used in the chemical engineering sector to produce batteries, particularly button cells. State-of-the-art button cells are typically structured as follows. A button cell typically consists of a cup into which a tablet made of metal oxide powder, the so-called cathode, is placed and pressed. In the subsequent assembly of the button cell, a separator is deposited on the pressed-in metal oxide, a gasket with the diaphragm sheet is inserted in the cup, the zinc powder (the anode) is dispensed onto a diaphragm sheet, and the lid (the negative pole) is placed on top. The opening of the cup can then be crimped inwards with a tool, wherein the lid is pressed down through the pressure of the gasket, and the button cell is sealed gastight.

This means that at least the following steps are needed for producing a cathode for a button cell using a rotary press: i) Pressing a tablet from metal oxide powder, ii) placing a cup into the die, iii) placing a tablet into the cup, and iv) pressing the tablet to the bottom of the cup.

It is known from prior art to use a first rotary press to produce the tablets from metal oxide powder. Then the tablets are fed into an assembly machine in which the tablets can be inserted into cups. The cup and the inserted tablets are then conveyed to a second rotary press. In this machine, the cups with the tablets are inserted into dies one after the other. In the subsequent pressing operation, the tablet is once again compressed by the rams, which makes the tablet flatter, while its diameter increases. The pressed-in tablet is now on the bottom of the cup and bearing against the cup edge without a gap. In this known method, three machines, that is, two rotary presses and an assembly machine, are mechanically coupled. The production workflow therefore is expensive, complex, and susceptible to disruption.

It is also known from prior art to use a production method which uses just two rotary presses, which are not mechanically connected. In this method, the tablet is pressed from metal oxide powder in a first rotary press, and the tablets are inserted into the cups and pressed down to the cup bottom in a second, separate rotary press. Each of these production steps requires one full rotation of the rotor. It would therefore be advantageous to provide a single rotary press which can carry out these sequential steps during one rotation.

Another sample application which requires sequential carrying out of various pressing operations is the production of multi-layer tablets or coating-core tablets (tablet in a tablet). Coating-core tablets consist of various materials and comprise a core, which is encompassed by a coating material. For example, the core can contain an active ingredient which is released in the body at a later point in time, i.e. after the coating material has dissolved.

In the known prior art of producing a coating-core tablet, first the core or core tablet is produced on a first rotary press. The cores are then inserted into dies on a separate rotary press. In this process, a powder for the coating is supplied to the dies after the cores have been inserted therein, such that the coat and the core are compressed into a coating-core tablet. Multiple rotary presses are therefore needed in the known prior art for the steps of producing the core and pressing the core with the coating. This results in increased costs and an increased space requirement. In addition, the production process is susceptible to disruptions due to the required coordination between the rotary presses.

US 2003/0072799 A1 discloses a method for producing multi-layer compressed dosage forms in which various modules and transfer systems are used. This method is characterized by an increased effort as well and cannot produce multi-layer tablets during a single rotation of a rotary press.

It is further known from EP 1 440 790 A1 and EP 1 437 116 A1 that multi-layer molded products can be produced by means of rotary presses having inner and outer top and bottom rams which can be moved relative to one another. Both the inner and the outer top and bottom rams each comprise at least two ram tips, such that a respective pair of inner or outer top ram tips can interact with a pair of inner or outer bottom ram tips in a single die bore. The shape and dimensions of the die bore depend on the outer ram tips. In these rotary presses, the inner top and bottom rams are connected to the inner ram shaft including a mushroom head, while the outer top and bottom rams interact with roller-guided guide parts. A control cam is provided for driving the mushroom head of the inner shaft for the inner rams and for driving the roller-guided guide-parts for the outer rams, respectively, in the upper and lower cam tracks of the rotary press. Since the inner and outer rams can be controlled separately, more complex molded products having various shapes can be produced on a pitch circle in a die bore. The disadvantage of this press is that it needs a complex and precisely adjusted control process by means of two upper and lower cam tracks with very long upper and lower die holders, wherein the main station includes two pairs of pressure rollers arranged on top of one another.

It would therefore be advantageous for many fields of application if sequential production steps, which can optionally build upon one another, could be carried out in a single rotary press using simple constructive means.

SUMMARY OF THE INVENTION

The problem to be addressed by the invention therefore is to eliminate the disadvantages of prior art and to provide a rotary press, which can carry out, one by one, different pressing operations, which may optionally build on one another, during one rotation.

According to the invention, this problem is solved by the independent claims. The dependent claims represent preferred embodiments of the device according to the invention and the methods according to the invention.

The invention therefore preferably relates to a rotary press for carrying out at least two pressing operations during a rotation of the rotary press, said rotary press including a rotor, a die table, a top ram guide for receiving top rams, and a bottom ram guide for receiving bottom rams, wherein the top rams comprise at least two top ram tips, wherein a first top ram tip is of a length which is by a length difference ($L_{D1}$) shorter than that of a second top ram tip, and the bottom rams comprise at least two bottom ram tips, wherein a first bottom ram tip is of a length which is by a length difference ($L_{D2}$) longer than that of a second bottom ram tip, the die table comprises first die cavities which are oriented towards the first top and bottom ram tips, such that a first material to be pressed can be pressed in the first die cavities in a first pressing operation, and a second material to be pressed can be pressed in the second die cavities in a second pressing operation during one rotation.

The rotary press according to the invention is of the generic type of rotary presses as known from prior art. The rotor preferably comprises a top and a bottom ram guide for receiving rams, such that powdery material can be pressed into a pellet or a tablet in the die cavities of a die table by interaction of top and bottom rams. In accordance with the invention, the top and bottom rams preferably form the press tools together with the die cavities of the die table for pressing a material into a pellet or a tablet. In accordance with this invention, the press tools preferably designate a unit of top rams, bottom rams, and dies, which are guided jointly during a rotation. It is preferred that the rotary press comprises a plurality of press tools, which are arranged concentrically in the top and bottom ram guides and in the die table. The top and bottom rams in the meaning of this invention preferably designate a unit of top and bottom ram tips, respectively, which are guided jointly during a rotation. In one embodiment, a ram can consist of multiple ram tips, which are guided jointly. However, it can also be preferred that the ram includes a ram shaft and two or more ram tips, which can be screwed to or inserted into the ram shaft. This makes it advantageously possible to replace the ram tips of the rams with little effort. But it can also be preferred that the rams consist of a ram shaft and two or more ram tips, wherein the ram shaft and the ram tips are integrally joined. The design of the top rams can determine the arrangement and length of the top ram tips, which are associated with the top ram. This applies likewise to the bottom rams, including at least two bottom ram tips. In accordance with the invention, the length of the ram tips preferably designates the extension of the ram tips along the pressing direction, perpendicular to the plane of the die table. In the case that the rams comprise a ram shaft, the length of the top ram tips is preferably measured from the bottom surface of the ram shaft, whereas the length of the bottom ram tips is measured from the top surface of the ram shaft. The length of inserted ram tips preferably is the length of the protruding portion of the inserted ram tips. For example, a preferred top ram can comprise a first top ram tip having a length of 12 mm, a second top ram tip having a length of 14 mm, a preferred bottom ram can comprise a first bottom ram tip having a length of 15 mm and a second bottom ram tip having a length of 13 mm. For this example, the length difference between the first and second top ram tips $L_{D1}$=2 mm. Likewise, the length difference between the first and second bottom ram tips $L_{D2}$=2 mm. According to the invention, particularly the length difference of the top and bottom ram tips in a ram is decisive. According to the invention, it is preferred that the top rams include a first top ram tip is of a length which is by a length difference ($L_{D1}$) shorter than that of a second top ram tip. This length difference of the two top ram tips has the effect that the second top ram tip is inserted into a second die cavity first during a press movement. Only after the second top ram tip has already been inserted into the second die cavity by the length difference ($L_{D1}$), the first top ram tip is in a position in which it is flush with the top surface of the die table and inserted into the first die cavity. In a reciprocal manner, the inventive length difference $L_{D1}$ of the bottom ram tips results in a staggered insertion of the bottom ram tips into the first and second die cavities.

In accordance with the invention, the rams comprising top and bottom rams, each having at least two ram tips of different lengths with respect to the plane of the die cavities, are also preferably called height-staggered or staggered rams. A rotary press having height-staggered rams represents a departure from prior art. While it is known to operate rotary presses with rams having two or more ram tips, so-called multiple rams, to produce tablets or other pellets in large quantities, the rams of the known prior art always comprise tips of identical lengths. Prior art multiple rams are used, for example, to produce tablets or pellets having an identical shape on a press. A person skilled in the art would have assumed that the use of top or bottom rams having ram tips of different lengths results in variations of the tablet or pellet properties. For example, the different lengths of ram tips of a multi-ram press tool could change the tablet weight, band height, or tablet hardness. The height-staggered rams of the rotary press according to the invention therefore represent a departure from prior art. It was realized, according to the invention, that the height staggering results in a number of surprising advantages for a rotary press.

For example, the height staggering of the ram tips of the top and bottom rams, respectively, can carry out independent pressing operations one after the other on a single rotary press during one rotation. It can for example be preferred to produce a first sort of tablets in a first half of a rotation of the rotary press through interaction of the first top and bottom ram tips in the first die cavities. During this first pressing operation, there is preferably no material to be pressed in the second die cavities. In a second half of the rotation, a second sort of tablets can be pressed in the second die cavities due to the design of the staggered rams according to the invention. Due to the height-staggered rams, these two pressing operations can be independent of one another. For example, the first material to be pressed can be ejected upwards by the first bottom ram tip, while the second bottom ram tip is at a position under the surface of the die table and does not interfere with the discharge of the first material to be pressed.

In a preferred embodiment, the length difference $L_{D1}$ is almost equal to the length difference $L_{D2}$. In accordance with the invention, the designations "nearly" and "about" are preferably understood to refer to a tolerance range of ±15%, preferably of ±10%. In this preferred embodiment, there is a reciprocal height-staggering of the rams, such that the distance between the bottom surface of the first top ram tip and the top surface of the first bottom ram tip is nearly equal to the distance of the bottom surface of the second top ram tip from the top surface of the second bottom ram tip. This is advantageous, for example, when producing first and second pressed products having the same band height. Preferred height-staggered rams can for example have the following length differences: $L_{D1}$=1 mm and $L_{D2}$=1 mm, $L_{D1}$=1.4 mm and $L_{D2}$=1.5 mm, $L_{D1}$=2.5 mm and $L_{D2}$=2.5 mm, $L_{D1}$=2 mm and $L_{D2}$=1.9 mm, $L_{D1}$=3 mm and $L_{D2}$=3 mm, $L_{D1}$=4 mm and $L_{D2}$=4 mm, $L_{D1}$=6 mm and $L_{D2}$=6.3 mm, $L_{D1}$=2.5 mm and $L_{D2}$=2.5 mm, $L_{D1}$=8 mm and $L_{D2}$=8.2 mm $L_{D1}$=10 mm and $L_{D2}$=10 mm or even $L_{D1}$=15 mm and $L_{D2}$=14.8 mm.

It can further be preferred that the length difference $L_{D1}$ is unequal to the length difference $L_{D2}$ for producing tablets of different heights or hardnesses. This flexibility for producing different pressed products or pressed products which build on one another is a particularly advantage of the rotary press according to the invention. Preferred height-staggered rams can therefore also have the following length differences, for example: $L_{D1}$=1 mm and $L_{D2}$=1.5 mm, $L_{D1}$=1.4 mm and $L_{D2}$=1.9 mm, $L_{D1}$=2 mm and $L_{D2}$=2.5 mm, $L_{D1}$, $L_{D1}$=2 mm and $L_{D2}$=4 mm, $L_{D1}$=3 mm and $L_{D2}$=5 mm, $L_{D1}$=4 mm and $L_{D2}$=5 mm, $L_{D1}$=6 mm and $L_{D2}$=7 mm, $L_{D1}$=6 mm and $L_{D2}$=8 mm, $L_{D1}$=7 mm and $L_{D1}$=5 mm, $L_{D1}$=6 mm and $L_{D2}$=4.5 mm, $L_{D1}$=8 mm and $L_{D2}$=5 mm, or even $L_{D1}$=3.5 mm and $L_{D2}$=2 mm, $L_{D1}$=1.5 mm and $L_{D2}$=0.8 mm, $L_{D1}$=2.2 mm and $L_{D2}$=1.5 mm, or even $L_{D1}$=0.9 mm and $L_{D2}$=0.6 mm.

Furthermore, the height-staggered rams make it possible to process the first pressed product further in a second pressing operation during a single rotation. For example, the first bottom ram tip can be operated in a first pressing operation such that its upper end is flush with the surface of the die table. Due to the height staggering, the second bottom ram is in this position preferably within the second die cavity, i.e. underneath the surface of the die table. So the first pressed product can for example be transferred into the second die cavity using a slider, a turnstile, or another conveying device. Then a second pressed product, which includes the first pressed product, can be produced by adding other materials. The height staggering of the rams advantageously allows a particularly reliable sequential production and optional further processing of pressed products during a single rotation of the rotary press. In this way, multi-layer pressed products can be produced in the first and second die cavities during a rotation.

Furthermore, it can be preferred that the rams include at least three or four ram tips each and the die table comprises at least three or at least four die cavities, each aligned accordingly. These ram tips can have staggered length differences among each other. It can also be preferred that, if the number of top ram tips is even, a first half of the top ram tips has a length which is by a length difference $L_{D1}$ shorter than the length of a second half of top ram tips. Reciprocally, it would be preferred for this embodiment that the first half of bottom ram tips has a length which is by a length difference $L_{D2}$ longer than the length of a second half of bottom ram tips. Advantageously, multiple first and second pressed products can be produced during a first and a second pressing operation. The increase in the number of ram tips for the height-staggered rams allows an increase in both the number and the complexity of the press products produced.

In accordance with the invention, a die cavity preferably designates a recess or an opening in a die table into which material to be pressed is inserted to be pressed into a pellet by the interaction of the top and bottom rams. A die cavity thus is a bore hole through the die table, which defines the compression space by a lateral boundary. The lateral boundary or side walls of the die cavities are preferably formed by the die table or by die inserts. The cross section of the die cavities can be different based on the desired shape of the pellets. For example, die cavities can preferably be circular, rectangular, triangular, star-shaped, ellipsoid, oval, or take other shapes. It is preferred, however, that the ram tips of the top and bottom rams have a cross section that is congruent with the corresponding die cavities, in order to press the material effectively as shaping tools. In accordance with the invention, the first and second die cavities preferably designate two separate cavities or bore holes in the die table, wherein the first top and bottom ram tips interact in the first die cavities, while the second top and bottom ram tips interact in the second die cavities.

In a preferred embodiment of the invention, the extension of the first die cavities and the extension of the first top and bottom ram tips are smaller than the extension of the second die cavities and the extension of the second top and bottom ram tips. The extension of the die cavities in accordance with the invention is preferably a characteristic extension of the cross section of a die cavity. In a preferred embodiment, in which the die cavity is characterized by a circular cross section, the extension preferably corresponds to the diameter of the circle. In the case of a square die cavity, the extension preferably corresponds to the length of the square. The ram tips which correspond to the die cavities preferably have a congruent cross section and thus nearly the same extension as the die cavities. The extension of the ram tips is adjusted such that these can be inserted into the die cavities in an exact fit. The pellets produced by the interaction of the ram tips also preferably take the cross section and thus the extension of the die cavities. Due to the design of the first die cavities with extensions of a different size, the first pressed product and the second pressed product have a different extension in cross section. Advantageously, the first pressed product, which has the smaller extension, fits geometrically into the second die cavities. It can for example be preferred that the die cavities have a circular cross section, wherein the diameter of the first die cavities is 3 mm and the diameter of the second die cavities is 4 mm. It can also be preferred that the die cavities have differently shaped cross sectional areas. For example, the first die cavities can preferably be squares having a side length of 3 mm, while the second die cavities have a circular opening with a diameter of 5 mm. The different extensions of the first die cavities and the second die cavities preferably have the effect that the first pressed products can be conveyed into the second die cavities. This allows particularly reliably to produce complex products such as multi-layer tablets or coating-core tablets in one rotation by pressing operations which sequentially build on one another.

The die cavities can be formed in a different manner in the die table. It can for example be preferred that the die table is present as a whole at the rotor and that the die cavities are formed by recesses or openings in the die table. It is preferred for circular die cavities to be formed by bore holes in a die table. In addition, it can be preferred to segment the die table, wherein multiple pairs of first and second die cavities are provided in each segment of the die table. The switch between the first and second die cavities is performed by switching die segments here.

In a preferred embodiment of the invention, the die table comprises recesses for die inserts, wherein the first die cavity and the second die cavity are present in one die insert. In this preferred embodiment, the die cavities are provided in so-called die inserts. The preferred die inserts allow particularly precise adjustment of the die cavities to the rams which are at least height-staggered in pairs. Furthermore, the die inserts can be disassembled particularly efficiently and fast together with the rams. Instead of using one die insert each for a first and a second die cavity, both die cavities can be replaced by replacing a single die insert.

In a preferred embodiment, the invention relates to a rotary press, which includes a transport device, wherein the transport device transports the first pressed product into the second die cavity. This embodiment advantageously allows carrying out pressing operations which build on one another during one rotation of the rotary press. In a first pressing operation, a first pressed product, for example a tablet with a first active ingredient, can be produced. Then this first tablet can be transferred into the second die cavity and processed further into a multi-layer tablet by adding another active ingredient or coating material. Various types of transport devices can preferably be used. These include sliders, scrapers, turnstiles, star wheels, grippers, vacuum heads, loops, or other mechanical conveying devices. According to the invention, the height-staggered rams allow the use of particularly efficient transport devices, which can push the first pressed product across the surface of the die table.

In a preferred embodiment, the transport device is characterized in that the transport device includes a turnstile or a slider and that the bottom ram can be moved after the first pressing operation to a position in which the upper end of the first bottom ram tip is flush with the surface of the die table and the first pressed product is transported into the second die cavity by turning the turnstile or by the slider. The preferred transport device in the form of a turnstile or slider allows transfer of the first pressed product into the second die cavity at a particularly rapid cycle rate. While the first bottom ram can be moved to a position in which the upper end of the bottom ram tip is flush with the surface of the die table, the second bottom ram tip is preferably located underneath the surface of the die table and within the second die cavities. The second die cavities are thus closed by the second bottom ram tip as a counterpart and ready for receiving the first pressed product. It was surprising in this context that the rams can be moved into this position rapidly, while the pressed product is moved into the second die cavities using a turnstile or a slider. Furthermore, the preferred transport devices do not only allow a rapid cycle rate, they are also surprisingly precise. The first pressed product can thus be placed at a centered position into the second die cavities, particularly by means of a turnstile or a slider. It was surprising in this context that the preferred transport devices can reliably place both first pressed products having a clearly smaller extension as well as such having about the same extension into the second die cavities in an exact fit.

In a preferred embodiment, the rotary press is characterized in that the first die cavities and the first top and bottom ram tips are arranged concentrically on an inner pitch circle and the second die cavities and the second top and bottom ram tips are arranged concentrically on an outer pitch circle. The "inner" pitch circle preferably designates a pitch circle having a smaller diameter about the axis of rotation compared to the "outer" pitch circle, which preferably encompasses the inner pitch circle. It was found that transporting the first pressed product after the first pressing operation to the second die cavities can be performed particularly fast and precisely if the first die cavities are concentrically arranged on an inner circle compared to the second die cavities. A gripping arm, a slider, or a turnstile can be used, for example, to move the first pressed product from inside towards outside in a swift, indexed motion. This transport along the centrifugal force was surprisingly more precise than in the opposite direction. Furthermore, the radial orientation of the first and second die cavities on an inner and outer circle makes it possible to place die cavities on the die table at a particularly high density. The preferred arrangement of the first and second die cavities does not only allow carrying out sequential pressing operations one after the other at a fast rate, but also results in increased productivity of the rotary press.

In a preferred embodiment, the invention relates to a rotary press, which is suitable for pressing tablets into cups and comprises a first filling station, a first pressing station, a cup inserting station, a transport device and a second pressing station, wherein the first feed station is configured to dose powder, preferably a metal oxide powder, into the first die cavities, the first pressing station is configured to press the powder in the first die cavities into a tablet in a first pressing operation, the cup inserting station is configured to insert cups into the second die cavities, the transport device is configured to insert the tablet into the cups which are located in the second die cavities, and the second pressing station is configured to press the tablet into the cups in a second pressing operation.

This preferred embodiment advantageously allows producing first a tablet or pellet in the first die cavities and to pass these on for further processing to cups in the second die cavities during a rotation. Then the tablet or pellet is pressed into the cup bottom in a second pressing operation. In the known prior art, at least two rotary presses are needed for pressing tablets into cups. Various auxiliary processes are required for this purpose, such as stocking, transporting, and feeding the tablets produced on a first rotary press to a second rotary press. The rotary press is therefore characterized, on the one hand, by saving space and material. On the other hand, since the auxiliary processes are eliminated, the preferred rotary press saves energy and makes the production process more efficient. It is particularly preferred that the rotary press is suited for pressing metal oxide powders into cups, whereby a cathode can be provided which can be further processed into a button cell. The preferred rotary press is not only suitable for the use in the chemical engineering industries for producing batteries, it has the advantages mentioned for other applications in which tablets or pellets are pressed in containers as well.

It is preferred that the filling station, the first pressing station, the cup inserting station, the transport device, and the second pressing station are arranged one after the other along the direction of rotation of the rotary press. Various known filling stations can be used to ensure the dosing of powdery material into the first die cavities. For this purpose, the filling station preferably comprises a feed shoe, which includes a material supply and is designed for dosing powdery material into the first die cavities. For the production of cathodes for button cells, it is preferred that the first and second die cavities have a circular cross section, wherein the diameter of the first die cavities is smaller than the diameter of the second die cavities. Other shapes of the die cavities can be preferred for other applications. After filling the powdery material into the first die cavities, a dosing device preferably adjusts the amount of powdery material in the first die cavities. For this purpose, the first bottom ram can be moved into a deep level intake position prior to filling a first die cavity and then lifted to the desired height. Excess powdery material is preferably removed using a scraper. The volume of the remaining powder is well-defined by this and allows the production of tablets with a constant weight. It is preferred that the first pressing station follows after the filling station. A pressure roller station can be preferred as the first pressing station. In a pressure roller station, it is preferred that top and bottom pressure rollers apply a force onto the top or bottom ram heads, respectively, such that the powdery material is pressed in the first die cavities by an interaction of the first top and bottom ram tips.

The cup inserting station preferably follows the first pressing station along the direction of rotation. The cup inserting station preferably places the cups into the second die cavities. A cup feeding device, for example a conveyor belt, can feed the cups to the cup inserting station. The cup inserting station preferably comprises a cup takeover and handover device, which can for example be designed as a turnstile. The cups are preferably separated prior to insertion, wherein the use of gripping arms is preferred. These allow precise positioning of the cups in the second die cavities. Advantageously, other prior art devices for inserting cups can be combined with the rotary press as well.

The subsequent transport device is designed such that it can transport the tablet produced in the first pressing operation into the cups, which are inserted into the second die cavities. The transport device preferably is a turnstile having radially extending pushing arms, the rotation of which can move the tablet on the die table. It is preferred for this purpose that the first bottom ram tip is moved to a position in which the upper end of the first bottom ram tip is flush with the surface of the die table. In this position, the tablet is lying on the first bottom ram tip level with the die table. Advantageously, transporting the tablets does not require any lifting, such as with grippers, to place the tablets into the cups. Instead, fast and precise transport of the tablets is achieved by just moving the tablets. Particularly, this effectively prevents abrasion or damage to the tablets during transport. Due to the height staggering of the bottom rams according to the invention, the second bottom ram tip is located in the second die cavities underneath the die surface during the transport of the tablets. It is preferred that the length difference $L_{D2}$ between the first bottom ram tip and the second bottom ram tip at least corresponds to the cup height, such that, in this position, the upper rim of the cup, which rests on the second bottom ram tip, is also positioned underneath the die surface. The tablet thus falls into the cup by means of gravity. This allows particularly fast, precise, and gentle insertion of the tablets into cups compared to prior art.

Preferred length differences for the height-staggered rams for pressing the tablets into the cups for cathodes are, for example, a $L_{D1}$ between 1 mm and 6 mm and a $L_{D2}$ between 1 mm and 6 mm; it is particularly preferred that $L_{D1}$ is nearly equal to $L_{D2}$. The tablets are inserted immediately after they were produced, such that even sensitive or brittle tablets can safely be inserted in the cups. In prior art, the transport of fragile tablets from a first rotary press to a second rotary press often results in damage and thus in increased numbers of rejects. It is preferred that the transport device is followed by the second pressing station, which presses the tablet into the cups by means of the second top and bottom ram tips. Advantageously, the pressing in of the tablets can be optimized by adjusting the length differences $L_{D1}$ and $L_{D2}$ of the staggered rams. During this second pressing operation, it is preferred that the second bottom ram tip nearly does not move, while the second top ram tip presses the tablet from above into the bottom of the cup. When the press tools pass the second pressing station, the bottom ram tip virtually functions as a counterpart, since it holds the cup in a fixed position. The pressing force is primarily applied to the tablet via the top ram tip. The effect of the force presses the tablet flatly against the cup bottom. Thus makes the tablet flatter, but it increases in diameter and gets into firm contact with the inner cup wall. A preferably centrally inserted tablet is symmetrically pressed into the cup bottom and particularly homogeneously clings to the rim of the cup. This means that the tablet is firmly and reliably pressed into the cup and can be subjected to further assembly steps without the risk of damage. The tablet pressed into the cup bottom is a multilayer second pressed product, which builds on the first pressed product (the tablet). It is preferred that the rotary press also comprises an ejection station which ejects the finish-pressed cups. In a particularly preferred embodiment, the tablets are metal oxide tablets and the cups are metal cups. The cups with the pressed-in metal oxide tablets preferably correspond to cathodes for producing a button cell. The sequence of the production steps on a single rotary press surprisingly makes it possible to produce button cells of particularly constant, high quality. This particularly prevents variations which can occur in prior art due to the separate production of the tablets on separate rotary presses and their storage and transport.

In a preferred embodiment, the first pressing station includes a measuring device for determining the pressing force during the first pressing operation, and the rotary press includes an ejection station, which is configured to eject tablets for which the pressing force deviates from a specified normal range during the pressing process. In this preferred embodiment, an additional quality control of the tablets can advantageously be provided. It is known that pressing stations, such as pressure roller stations, include a measuring device, e.g. a measuring cell, which determines the pressing force during a pressing operation. For example, a measuring cell with a measuring arm can be located inside a pressing station, and the bending of said arm allows a conclusion regarding the force applied for pressing. It is preferred that a normal range for the pressing force applied is specified depending on the material property and the desired band height or hardness. The normal range preferably includes a tolerance, which reflects the permissible variation of the tablet properties. A fault has occurred if a pressing force which deviates from this normal range is applied during the first pressing operation. It could be, for example, that not enough material was dosed into the first die cavities. It could also be that the first material to be pressed is contaminated. If the pressing force deviates from the normal range, it is preferred that defective tablets are removed from by means of an ejection station. In a preferred embodiment, the defective tablet is lifted off in the ejection station by the first bottom ram tip, such that it gets onto an ejector bar and can be discharged. It was found that the height staggering of the bottom rams allows particularly precise ejection, since the second bottom ram tip is preferably located underneath the surface of the die table during this process.

In another advantageous embodiment of the invention, the second pressing station includes a measuring device for determining the pressing force during the second pressing operation, and the rotary press includes a sorting station, which is configured to direct cups with pressed-in tablets during the second pressing operation either to a transport path for suitable cups with pressed-in tablets or to a transport path for unsuitable cups with pressed-in tablets depending on the pressing force, if the pressing force deviates from a specified normal range. This preferred embodiment makes it possible to monitor the correct pressing of the tablets into the cups and to sort out cups with pressed tablets which do not meet the requirements. This embodiment is particularly preferred for monitoring cathodes. It is preferred to specify a normal range, which corresponds to the pressing force in the second pressing operation, which results in particularly homogeneous pressing of the tablets into the cups and thus preferably results in suitable cathodes. If a deviation from this normal range is detected using the measuring device for determining the pressing force, this indicates a defective tablet or a tablet incorrectly inserted into the cup. If for example a defective broken tablet was pressed into a cup, the pressing force needed is smaller due to the smaller surface area of, for example, half the tablet. A defective cathode can thus be detected and reliably sorted out by means of this pressing force control, such that this cathode will not enter into the further manufacturing process. It is preferred that the sorting station directs defective cathodes onto the transport path for unsuitable cathodes. It can be preferred for this purpose that the sorting station includes a two-part ejector bar, wherein suitable cathodes are lifted into one section of the ejector bar and unsuitable cathodes are lifted into the other section of the ejector bar. It is preferred that the top ram tip stays on the pressed-in metal-oxide tablet during the ejection of the cathode, until the bottom of the cup has reached the top side of the die table. An automatic holding-down device preferably prevents the top ram tip from getting stuck on the inner cup wall and lifting the cup above the level of the die plate. Likewise, the good cathodes can be supplied to a discharge chute by means of a scraping device and guided into a collection container, whereas the defective cathodes get into a separate waste container by means of a pneumatic individual sorting system.

In a particularly preferred embodiment of the rotary press, both pressing stations comprise measuring devices for the pressing force, such that both defective tablets and defective cathodes can be sorted out. This combined safety check ensures a particularly high quality of the pressed cathodes. Due to the double quality assurance, the preferred rotary press is characterized by consistent high quality of the cathodes, even at strongly increased production rates.

The invention further relates to a method for producing cathodes for button cells using a rotary press according to the invention, said method comprising the following steps:

a) Dosing powder, preferably a metal oxide powder, into first die cavities by means of a filling station
b) Pressing the powder, preferably a metal oxide powder, into tablets by means of a first pressing station, wherein optionally the pressing force is determined
c) Optionally ejecting tablets for which a pressing force was determined in step c) which deviates from a normal range
d) Inserting the cups into the second die cavities by means of a cup inserting station
e) Inserting the tablet into the cups, which are located in the second die cavities, by means of a transport device, preferably including a turnstile
f) Pressing the tablet into the bottom of the cup by means of the second pressing station and the interaction of the second top ram tips and second bottom ram tips, wherein optionally the pressing force is determined
g) Ejecting the cathodes, wherein optionally the cathodes are directed to a transport path for suitable cathodes or to a transport path for unsuitable cathodes depending on the pressing force determined in step f) by means of the sorting station.

This preferred method allows the production of large numbers of cathodes in a particularly cost-saving manner by means of a single rotary press. The method preferably uses those preferred embodiments of the rotary press according to the invention which is suitable for pressing tablets in cups. Advantages mentioned for technical features of the preferred embodiment of the rotary press advantageously also apply to the method described. For example, it is disclosed for a preferred rotary press for pressing tablets that a turnstile as transport device allows particularly fast and precise transport of the tablets into the cups. A person skilled in the art concludes that a turnstile is also a preferred transport device for use in the method described and that the advantages mentioned with respect to the transport of the tablets into the cups also apply to the method.

In another preferred embodiment, the invention relates to a rotary press for carrying out at least three pressing operations during one rotation of the rotary press and is characterized in that the rotary press is suitable for producing coating-core tablets and that the rotary press comprises a first filling station, a first pressing station, a second filling station, a second pressing station, a transport device, a third filling station, and a third pressing station, wherein the first filling station is configured to dose a first powder into the first die cavities, the first pressing station is configured to press the first powder into a core tablet in the first die cavities in a first pressing operation, the second filling station is configured to dose a second powder into the second die cavities, the second pressing station is configured to tamp the second powder against the second die cavities in a second pressing operation, the transport device is configured to insert the core tablet into the second die cavities onto the second powder already pressed in, the third filling station is configured to dose the second powder into the second die cavities, whereby the core tablet is covered by the second powder, and the third pressing station is configured to press the core tablet coated with the second powder in the second die cavities into a coating-core tablet.

The preferred rotary press is more advantageously suitable for carrying out at least three sequential pressing operations, wherein the materials to be pressed/pressed products can be further processed in pressing operations that build on one another. It is particularly preferred that the first filling station, the first pressing station, the second filling station, the second pressing station, the transport device, the third filling station, and the third pressing station are arranged along the direction of rotation of the rotary press. It is preferably possible to dose powdery material into the first die cavities by means of the first filling station. Preferably, a feed shoe as known from prior art can be used. Then the first material to be pressed is pressed in the first die cavities by means of the first pressing station. It is particularly preferred that, for producing the coating-core tablets, the die cavities have a circular cross section, wherein the diameter of the first die cavities is smaller than the diameter of the second die cavities. By pressing the powder in the first pressing operation, the first material to be pressed preferably forms the core of the coating-core tablet. In accordance with the invention, the terms core and core tablet are preferably used synonymously. The pharmaceutical composition of the core is different from that of the coating. For example, the core can include a first active ingredient, which, after oral intake, is absorbed by the organism with a time delay after the coating is digested. The second powder therefore preferably is a powdery material which form the coating of the coating-core tablet. The second powder can be dosed using the second filling station into the second die cavities, while these are closed from below by the second bottom ram tips. The second powder is preferably tamped by the interaction of the second top and bottom ram tips against the second bottom ram tips using a second pressing station. This allows stable reception of the core tablet. This pressing step is preferably called tamping in accordance with the invention. The transport device can advantageously be used to transport the core produced in the first pressing operation easily and swiftly into the second die cavities. The height-staggered design of the bottom rams displays the advantages mentioned in this process. The core is preferably transported while the first bottom ram tip is flush with the level of the die table surface. In this positioning, the second bottom ram tip is underneath the die surface in the second die cavities. It is preferred that the length difference $L_{D2}$ is at least half the band height, preferably at least the band height of the coating-core tablet to be produced. Now the core can be moved on the die table into the second die cavities with particularly low abrasion by a transport device, preferably a turnstile or a slider. It is not necessary to lift or grip the tablet or to carry out other transport movements susceptible to disruption. Instead, the core tablet falls centered onto the coating powder, which is tamped against the second bottom ram tip in a second die cavity. Advantageously, this allows precise positioning of the core tablet within the coating-core tablet to be produced.

A person skilled in the art will see that the length differences $L_{D1}$ and $L_{D2}$ of the staggered rams are preferably adjusted to the production of the desired coating-core tablets. The length differences thus do not only depend on the dimensions of the core and the coating-core tablet, but also on the properties of the material to be pressed. The compression ratio of the material to be pressed plays a significant role in multi-layer or coating-core tablets. The compression ratio of bulk powder into a pellet can preferably be between 1.5 to 1 and 7 to 1. Preferred length differences of the staggered rams for producing coating-core tablets are for example a $L_{D1}$ between 0.5 mm and 4 mm and a $L_{D2}$ between 0.5 mm and 4 mm. The third filling station preferably allows covering of the core from above with the coating powder. The third pressing station preferably follows directly after the third filling station and is configured to press the third multi-layer material to be pressed by interaction of the second top and bottom ram tips. The third pressed product preferably consists of an inner core consisting of the first powder and an outer coating consisting of the second powder and forming the coating-core tablet.

It was surprising that coating-core tablets can be produced during one rotation using a rotary press which comprises the top and bottom rams staggered according to the invention. While in prior art separate rotary presses were used to press the core tablets and then to coat them, this can now be carried out on a single rotary press. This saves purchasing costs for energy and for the operation of presses. Furthermore, the production requires less space than prior art solutions. It was particularly surprising that the combination of the various pressing operations on one rotary press does not result in reduced quality, but even improves the quality of the coating-core tablets. Despite the use of different powders in successive steps on one press, a high purity level of the individual ingredients of the coating-core tablets can be ensured. This is because the height-staggered rams in conjunction with a transport device allow exact carrying out and separation of each production step and pressing operation.

In a preferred embodiment of the invention, the rotary press is characterized in that the pressing stations comprise top and bottom pressure rollers, which act on the rams. It is preferred that the pressing stations are designed as pressure roller stations. Such pressure roller stations preferably comprise a top reception device for top pressure rollers and a bottom reception device for bottom pressure rollers. It was found that the application of force onto the top and bottom rams can be controlled particularly precisely by means of the pressure rollers. This allows homogeneous pressing at a high throughput.

In a preferred embodiment of the invention, the first pressing station comprises a measuring device for determining the pressing force during the first pressing operation, and the rotary press includes an ejection station, which is configured to eject core tablets for which the pressing force deviates from a specified normal range during the pressing process. In this preferred embodiment, the quality of the pressed core tablets is checked by means of a force measurement in the first pressing station. The pressing station can preferably be a pressure roller station, comprising a top and a bottom pressure roller, wherein the pressing force applied during the first pressing operation can be determined using a measuring device. If the pressing force during the first pressing operation deviates from the specified normal range, it is very likely that a fault has occurred. It can for example be determined if the core tablet is too light or too heavy, or if it deviates from the specified product properties with respect to band height or tablet hardness. The core tablets can be sorted out swiftly and at high precision by means of an ejecting station. In the known prior art, transport and storage steps are carried out on the core tablets after quality control to feed them for coating into a second rotary press. Damage occurring during transport in prior art can only be detected by costly additional checks. Since the pressing operation is carried out on the same rotary press in which the core tablet is inserted into the coating, higher quality of the coating-core tablets can be ensured.

In a preferred embodiment of the invention, the rotary press is characterized in that the third pressing station comprises a measuring device for determining the pressing force during the third pressing operation and the rotary press includes a sorting station, which is configured to guide coating-core tablets during the third pressing operation to a transport path for suitable coating-core tablets or to a transport path for unsuitable coating-core tablets depending on the pressing force during the third pressing operation. In this embodiment, it is preferably possible to monitor the quality of the finished product. If the pressing force determined in the third pressing operation deviates from a specified normal range, the coating-core tablets are sorted out by means of the sorting station. The sorting station can preferably include a two-part ejector bar with separate transport paths for correct and defective coating-core tablets. It was surprising that an efficient and fast sorting mechanism for suitable and unsuitable coating-core tablets can be implemented on a single rotary press. The quality control of the coating-core tablet, together with monitoring the quality of the core tablet, on a single rotary press has synergy advantages because it reduces systematic detection errors.

In a preferred embodiment, the invention relates to a method for producing coating-core tablets using a rotary press according to the invention or preferred embodiments thereof, the method comprising the following steps:

a) Dosing a first powder for the core of the coating-core tablet into first die cavities by means of a first filling station
b) Pressing the first powder into core tablets by means of a first pressing station, wherein optionally the pressing force is determined
c) Optionally ejecting core tablets for which a pressing force was determined in step b) which deviates from a normal range
d) Dosing a second powder for the coating of the coating-core tablet into second die cavities by means of a second filling station
e) Tamping the second powder by means of a second pressing station
f) Inserting the core tablet into the tamped second powder, which is located in the second die cavities, by means of a transport device, preferably including a turnstile
g) Dosing the second powder into second die cavities by means of a third filling station, such that the core tablet is covered with the second powder
h) Pressing the core tablet coated with the second powder into a coating-core tablet by means of a third pressing station, wherein optionally the pressing force is determined
i) Ejecting the coating-core tablet, wherein optionally the coating-core tablets are directed to a transport path for suitable coating-core tablets or to a transport path for unsuitable coating-core tablets depending on the pressing force determined in step h).

The method allows sequentially carrying out at least three pressing operations, wherein the materials to be pressed are further processed during a rotation. This is a special further development compared to prior art. It was particularly surprising that the method can be used to produce large numbers of coating-core tablets during one rotation on one rotary press. Separate rotary presses and a transport of the pressed products between the same is advantageously not needed. The method preferably uses that preferred embodiment of the rotary press according to the invention which is suitable for carrying out at least three pressing operations. Advantages mentioned for technical features of the preferred embodiment of the rotary press advantageously also apply to the method described. For example, it is disclosed for a preferred rotary press for pressing coating-core tablets that those cores are preferably pressed in the first die cavities which are present on an inner pitch circle. The extension of the first die cavities is preferably smaller than the extension of the second die cavities, which are arranged concentrically on an outer pitch circle. This results in a particularly gentle and swift transport of the cores for the subsequent coating in the preferred embodiment of the rotary press. A person skilled in the art can see that for example the dimension and type of the die cavities are also preferred in the method described and that the advantages mentioned with respect to the transport of the core tablets also apply to the method.

The invention will be explained in detail with reference to examples below, without being restricted to these examples.

DETAILED DESCRIPTION OF THE FIGURES

Figure 1:
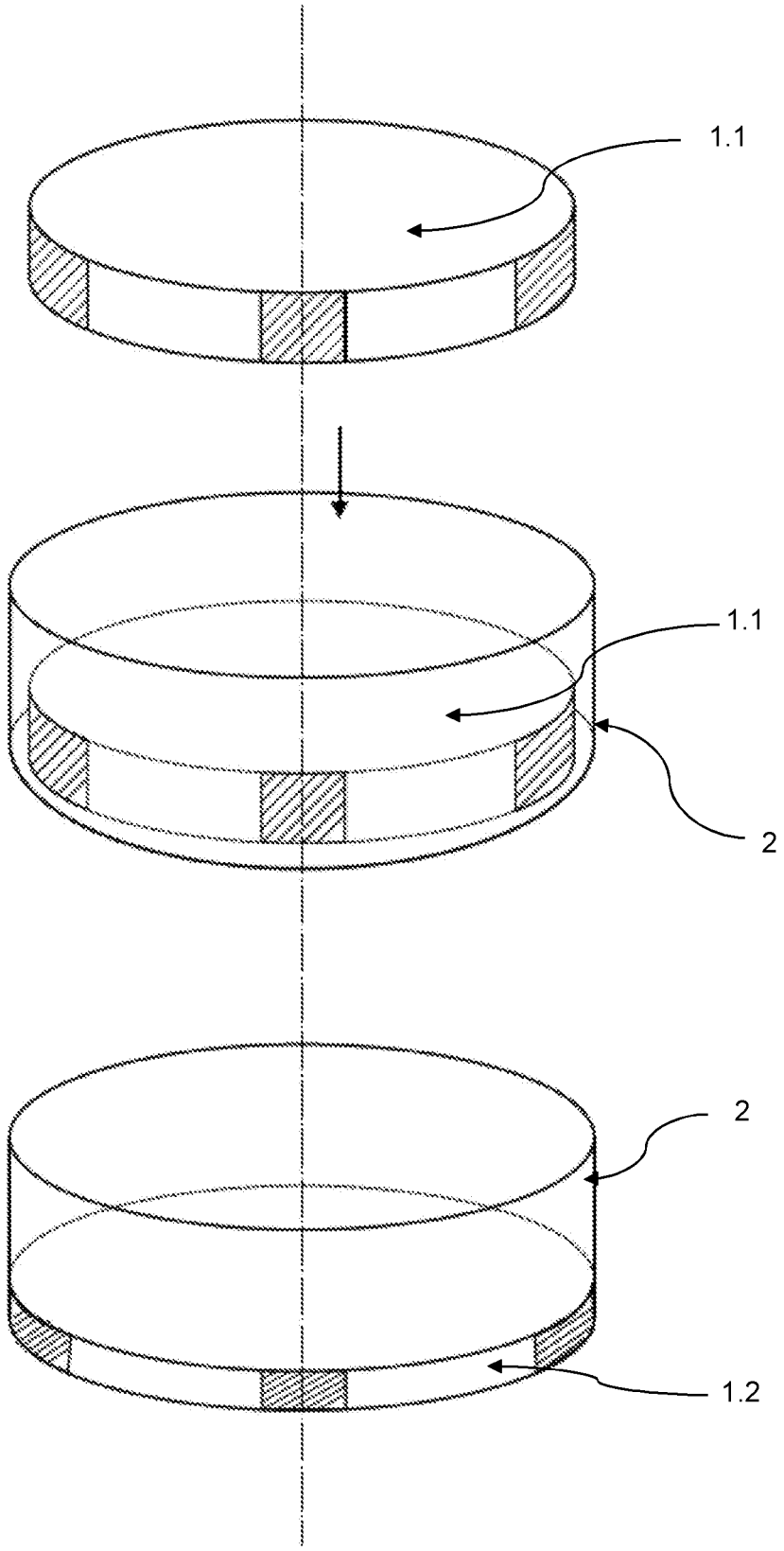
FIG. 1 Schematic representation of a preferred embodiment of a cathode

FIG. 1 shows a schematic representation of pressing tablets 1 into cups 2 like it is carried out for the production of cathodes. The bulk metal oxide tablet 1.1 has a preferably smaller diameter than the cups 2 and is inserted into the cup 2. The band height of the metal oxide tablet is reduced while its diameter increases due to the interaction of top and bottom rams (not shown). In this process, the tablet 1 is pressed flatly into the cup bottom. The flatly pressed-in metal oxide tablet 1.2 thus is in firm contact with the inner wall of the cup. Air can escape during the pressing operation, such that the flatly pressed-in metal-oxide tablet 1.2 is firmly and securely present in the cup 2.

Figure 2:
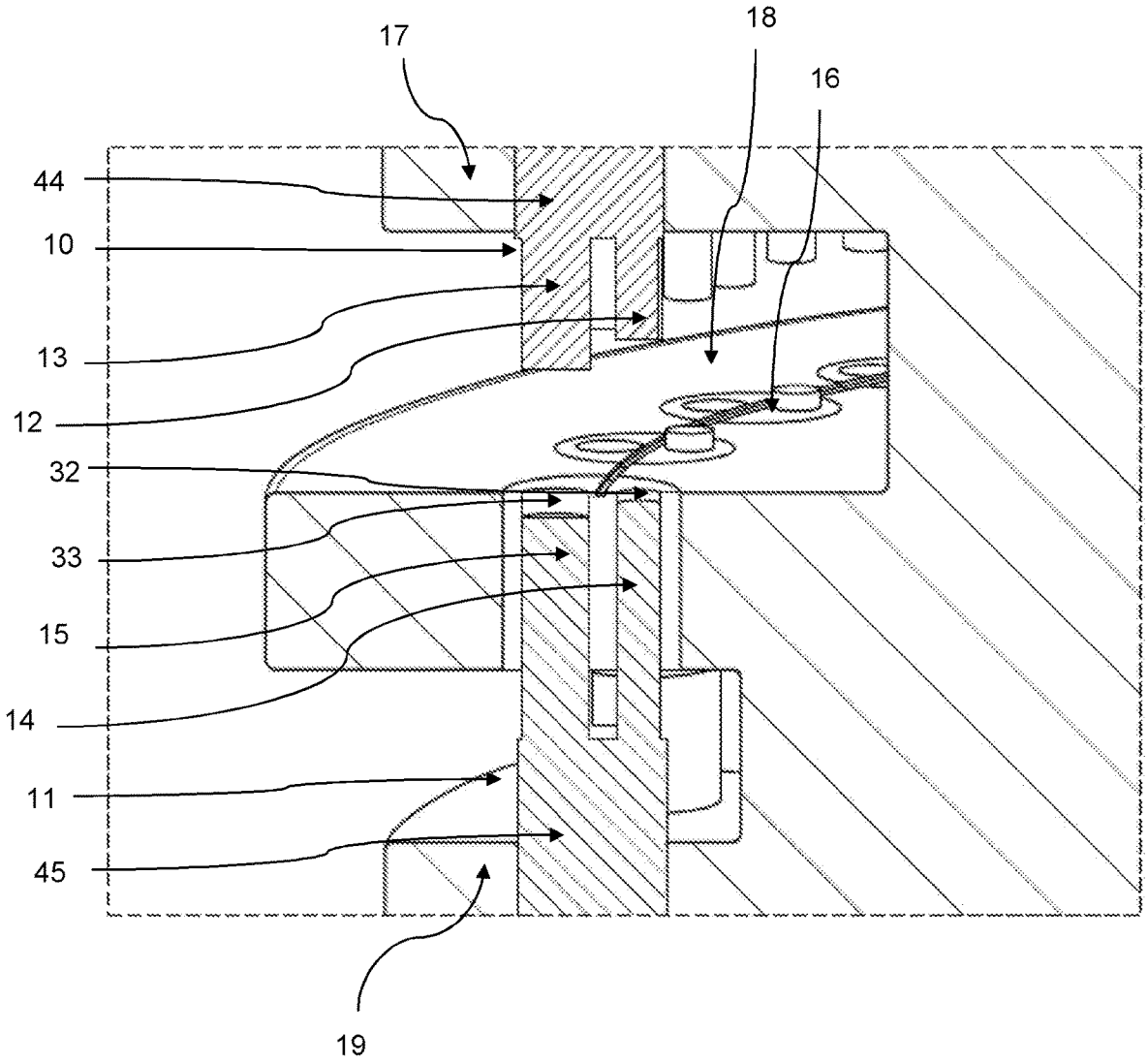
FIG. 2 Schematic representation of a cross section of a rotor of a preferred embodiment of the rotary press for illustrating the height-staggered rams FIG. 3 Schematic representation of a side view of a preferred embodiment of the rotary press for illustrating the ejection of pressed tablets by means of the height-staggered bottom rams FIG. 4 Schematic representation of a preferred embodiment of a rotary press for producing cathodes for button cells FIG. 5 Schematic top view of a preferred embodiment of the rotary press of FIG. 4 for illustrating the successive steps for producing a cathode for button cells FIG. 6 Schematic representation of a preferred embodiment of the transport device designed as a turnstile for transferring tablets from the first die cavities to the second die cavities FIG. 7 Schematic representation of a preferred embodiment of the sorting station for ejecting and sorting the pressed cathodes FIG. 8 Schematic representation of a preferred embodiment of a rotary press for producing coating-core tablets FIG. 9 Overview of various applications for preferred embodiments of the rotary press

FIG. 2 shows a schematic representation of a preferred embodiment of the height-staggered rams 10 and 11. The top ram 10 is located in the top ram guide 17 and comprises a first top ram tip 12 and a second top ram tip 13. The length of the first top ram tip 12 is by a length difference $L_{D1}$ shorter than the length of the second top ram tip 13. It is further preferred that the first top ram tip 12 has a smaller diameter than the second top ram tip 13. The bottom rams 11, on the other hand, are guided by means of a bottom ram guide 19 and include a first bottom ram tip 14 (not drawn in) and a second bottom ram tip 15 (not drawn in). The length of the first bottom ram tip 14 is by a length difference $L_{D2}$ longer than the length of the second bottom ram tip 15. In the embodiment shown, the length differences $L_{D1}$ and $L_{D2}$ are identical. Furthermore, the first top and bottom ram tips 12 and 14 have an identical shape and an identical diameter. The same applies to the second top and bottom ram tips 13 and 15. The top and bottom rams 10 and 11 are aligned with the first die cavities 32 and the second die cavities 33. The size and shape of the circular die cavities 32 and 33, respectively, corresponds to the size and shape of the aligned pairs of top and bottom ram tips 12 and 14 or 13 and 15, respectively. In the embodiment shown, the die cavities are formed by openings in the die inserts 16, which are located in recesses of the die table 18.

Figure 3:
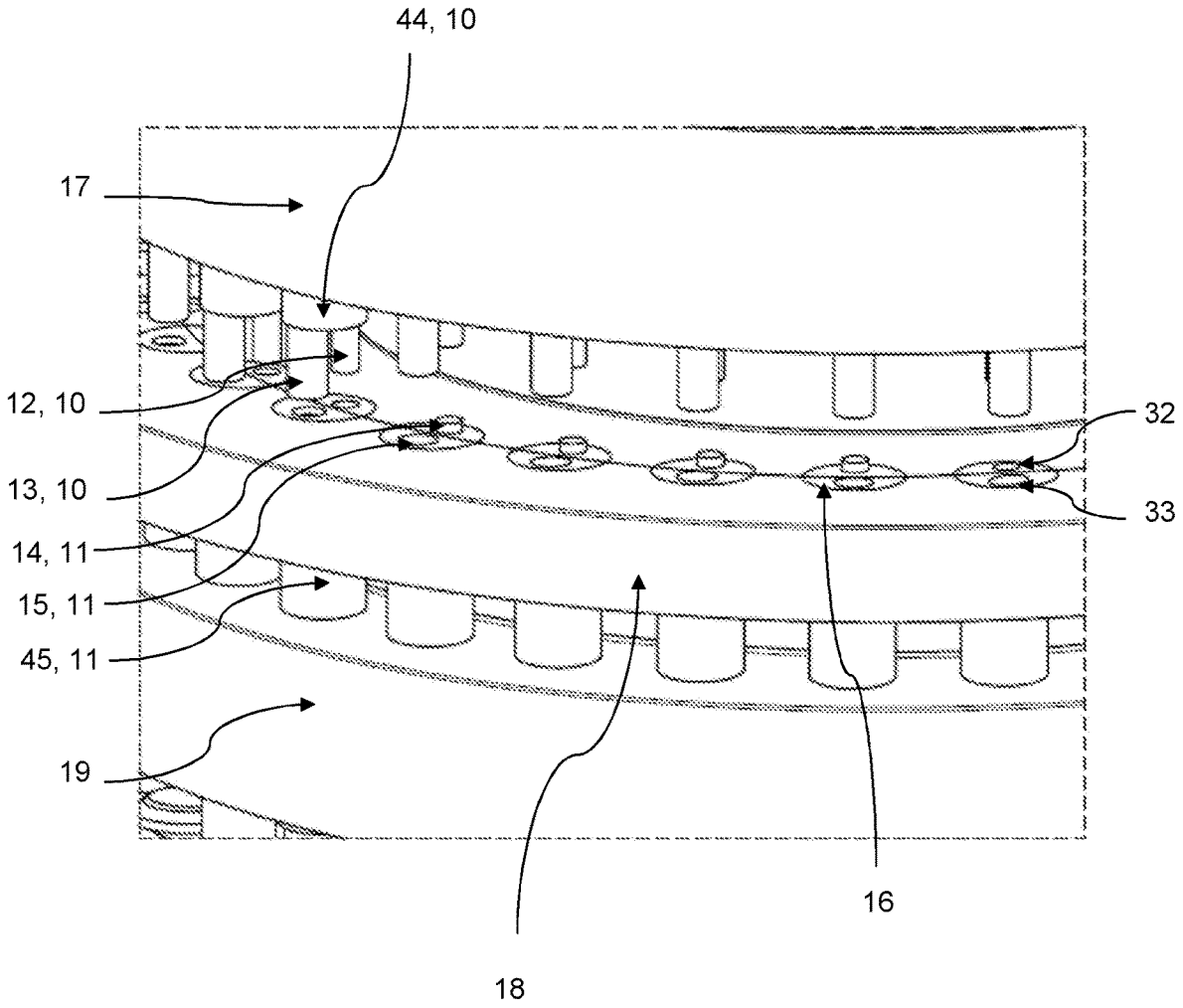

FIG. 3 shows a side view of the preferred embodiment of a rotary press, which includes height-staggered rams, according to FIG. 1. As shown in FIG. 2, the first top and bottom ram tips 12 and 14 are arranged on an inner pitch circle, while the second top and bottom ram tips 13 and 15 are guided on an outer pitch circle. The bottom ram tips 14 and 15 can be seen in the central four die inserts 16. The outer, second bottom ram tip 15 is flush with the upper edge of the die table. The inner, first bottom ram tip 14 projects beyond the upper edge of the die due to the length difference $L_{D2}$. Due to the height staggering of the bottom rams, the second bottom ram tips 15 advantageously do not represent an obstacle for ejecting the tablets 1 by means of the first bottom ram tips 14.

Figure 4:
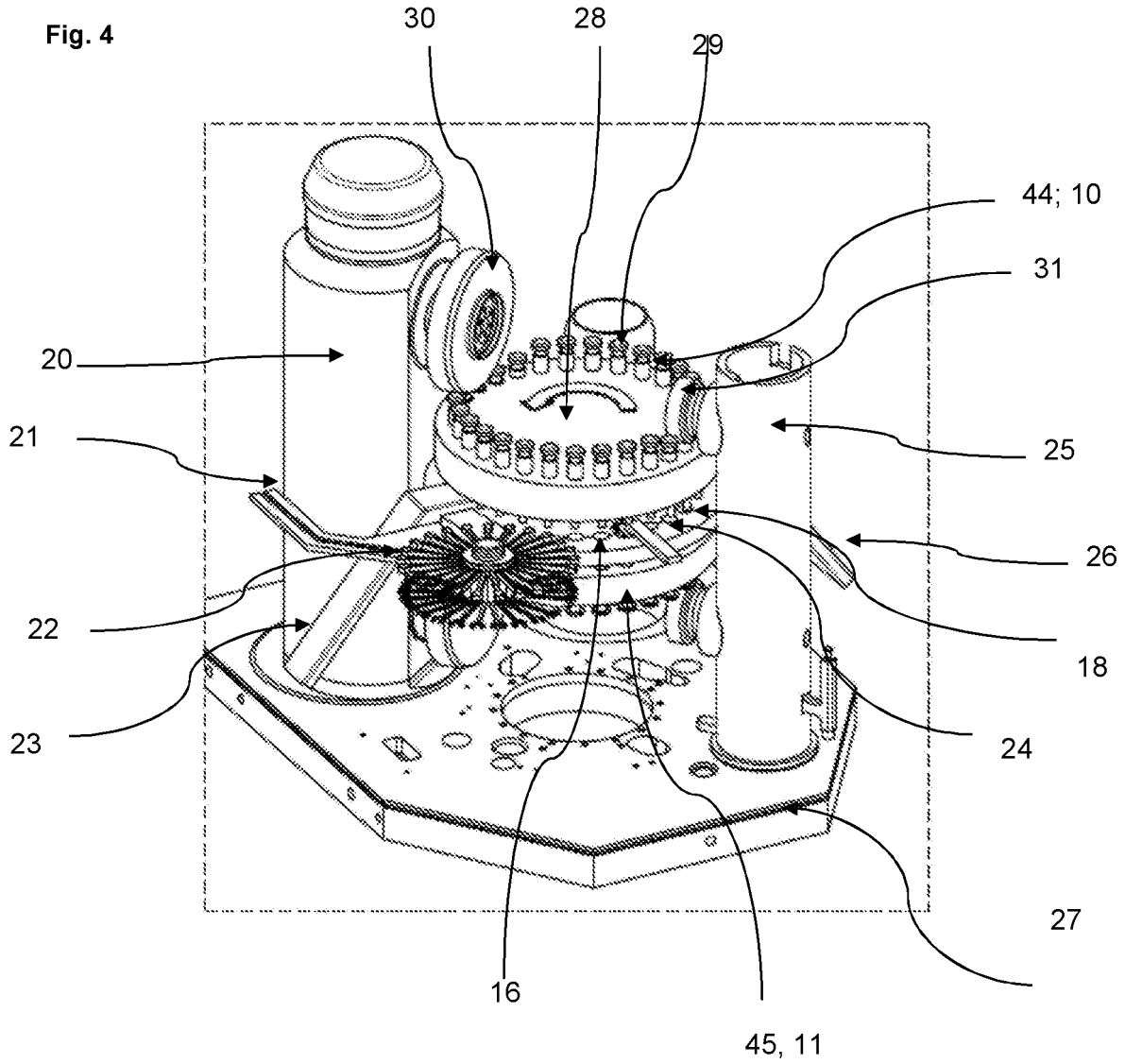
Figure 5:
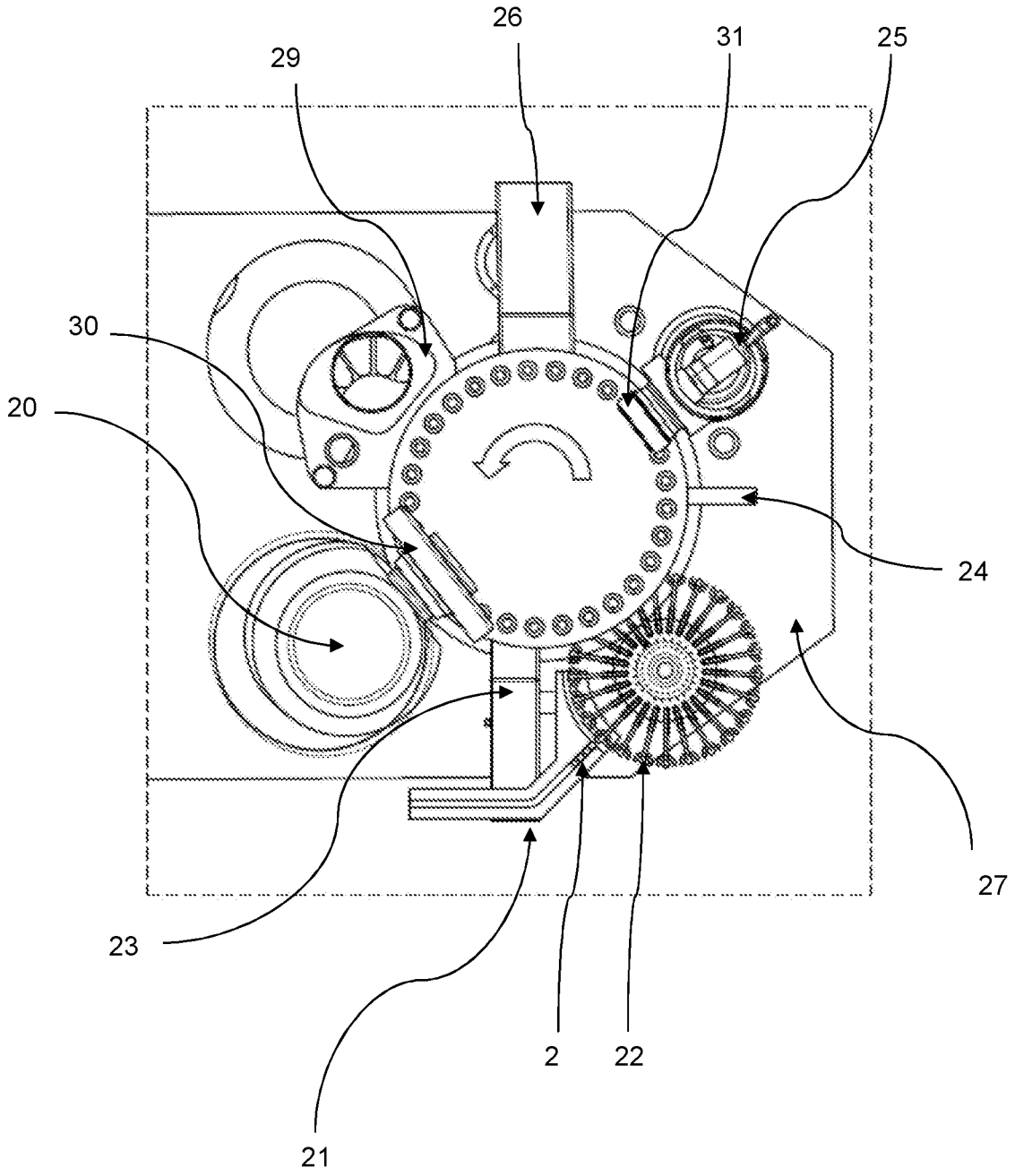
Figure 6:
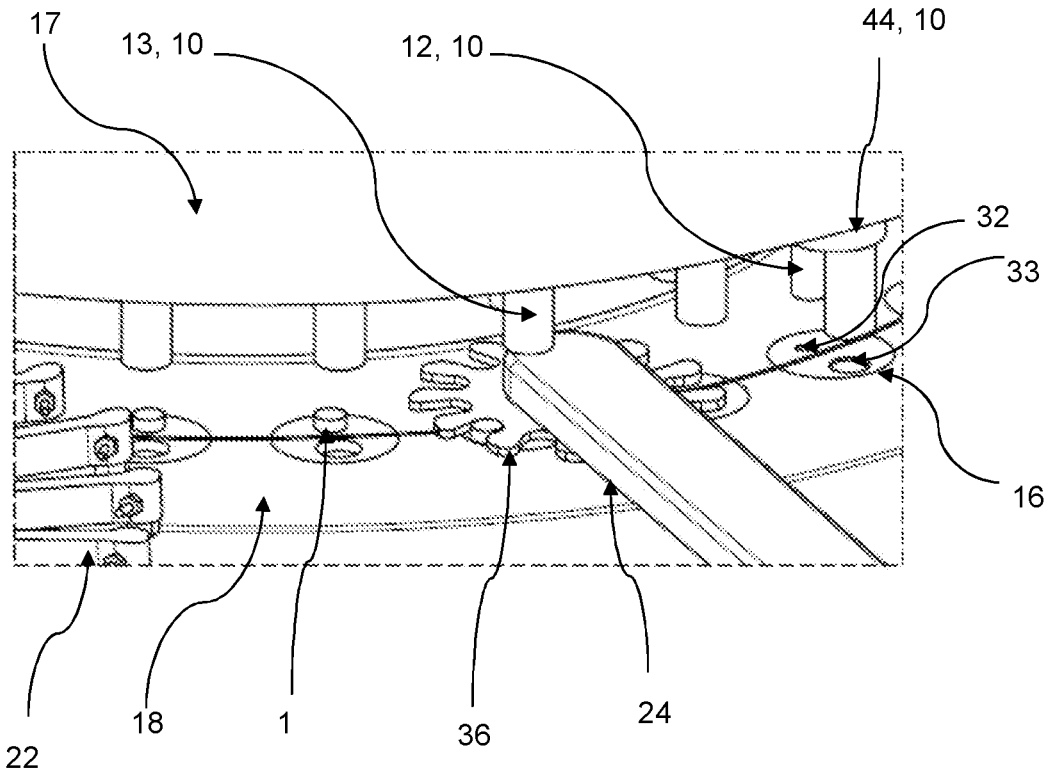
Figure 7:
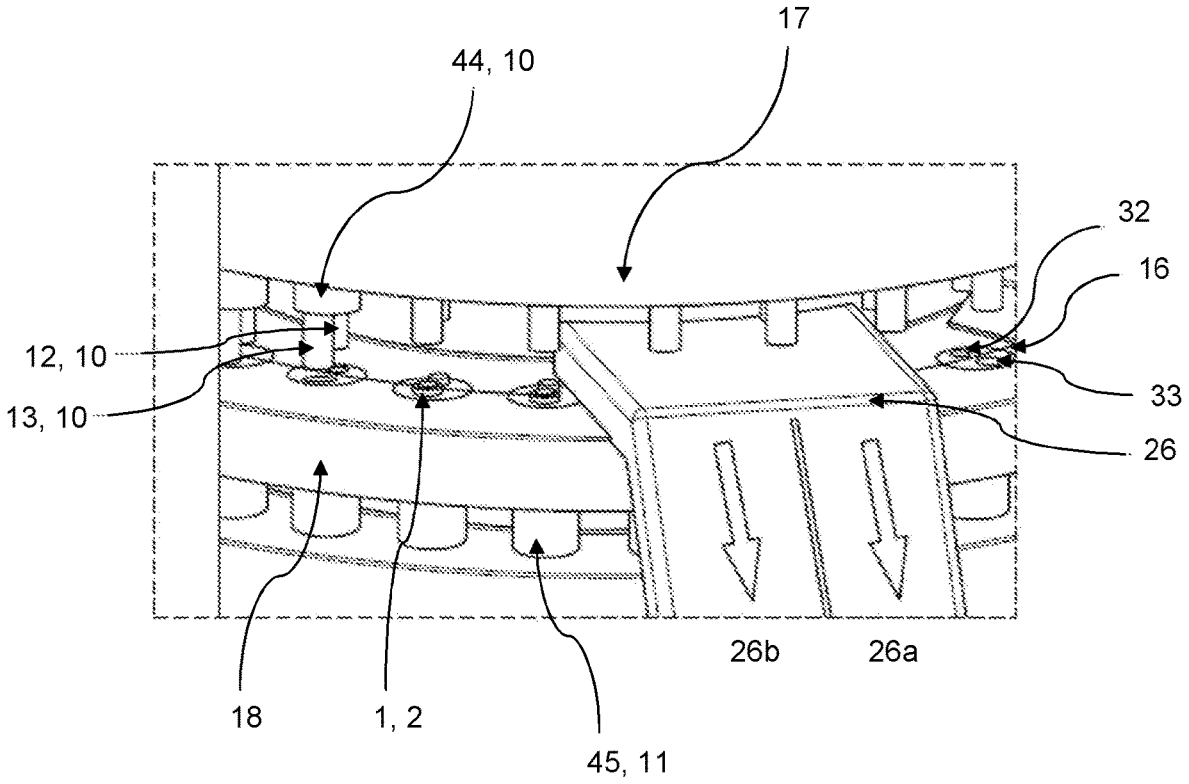

FIG. 4 and FIG. 5 show a schematic perspective view and top view of a preferred rotary press for pressing tablets in cups. The tablets preferably are metal oxide tablets for producing cathodes for button cells. The components of the rotary press are mounted onto a mounting plate 27. For a better overview, the machine housing, the machine base, and the drive system of the rotary press are not shown. The rotor 28 of the rotary press includes a top and a bottom ram guide 17 and 19, a die table 18, and top and bottom rams 10 and 11. The direction of rotation of the rotor 28 is indicated by an arrow. During the rotation of the rotor, i.e. a rotation of the rotary press, the rams rotate together with the die inserts 16 in the die table 18 through various functional assemblies or stations, which cause the production process of the cathodes. The assemblies or stations of the rotary press are described in accordance with their order of operation along the direction of rotation of the rotor 28. By means of the first filling station 29, the first powder, preferably the metal oxide powder, is filled into the first die cavities of the die inserts. As can be seen in FIG. 5, the filling station 29 for this purpose preferably includes a feed shoe with a material supply system, impellers, and a scraping device for filling and dosing the metal oxide powder into the first die cavities. After filling the first die cavities 32, the die insert 16 rotates under the first pressing station 20. In the preferred embodiment, this is a pressure roller station having a top pressure roller 30 and a bottom pressure roller (not visible). The top ram shafts 44 pass under the top pressure roller 30 during the rotation. In this way, the top rams 10 are subjected to a downward pressing force. Likewise, the bottom rams 11 are subjected to an upward pressing force, such that the first top and bottom ram tips press the powder in the first die cavities 32 into tablets 1. It is preferred that the pressing force is determined at the first pressing station 20 by means of a measuring cell. If the pressing force determined should deviate from a specified normal range, the defective tablet is ejected in the ejection station 23. The ejection station 23 preferably includes a discharge chute, and ejection is carried out by lifting the first bottom ram tips 14. After producing the tablets 1 and quality check by the electronically controlled ejection station 23, the cups 2 are inserted into the second die cavities 33. For this purpose, the cups 2 are supplied by means of a cup feeding device 21 in a transport bar of a vibration feeder and conveyor belt of the cup inserting station 22. The cup inserting station 22 preferably includes a turnstile with gripping arms, which takes over the cups 2 and transfers them in a rotational movement to the second die cavities 33. The cup inserting station 22 first separates the cups 2 for subsequent precise insertion. This allows a high cycle rate of inserting the cups 2. After inserting the cups, the tablets 1 are transferred into the cups 2 by means of the transport device 24. FIG. 6 schematically shows the operation of the preferred transport device 24. After inserting the tablet 1 into the cups 2, which are located in the second die cavities 33, the tablet 1 is pressed in by the second pressing station 25. It is preferred that the second pressing station also is a pressure roller column, and like at pressing station 20, a top pressure roller 31 and a bottom pressure roller (not shown) interact with the rams. It is preferred that the pressure rollers are adjusted such that the bottom rams 11 remain in their position nearly constantly. During the second pressing operation, the second bottom ram tip 15 therefore acts as a counterpart, and the second top ram tip 13 can press the tablet 1 uniformly and homogeneously onto the cup bottom. This effectively prevents air pockets. In the case of metal oxide tablets, the cups 2 with the finished pressed-in tablets 1 are called cathodes, which can be further processed into button cells. It is preferred that the pressing force is determined during the second pressing operation. Suitable and unsuitable cathodes are directed to different containers in a sorting station 26 by comparing the pressing force to a specified normal range. FIG. 7 showed a schematic representation of the operation of the sorting station 26.

FIG. 6 shows a schematic view of a preferred transport device 24 for transferring the tablets 1 into the cups 2. The first bottom ram tips 14 are moved to a position in which the upper ends of the first bottom ram tips 14 (not drawn in) are level with the surface of the die table 18. Thus the tablets 1 are at the level of the surface of the die table 18. It is preferred that the second bottom ram tips 15 (not drawn in) have a length that is by a length difference $L_{D2}$ shorter than the length of the first bottom ram tips 14, wherein $L_{D2}$ is selected such that $L_{D2}$ is greater than or equal to the cup height. In this position, the cups 2 lying on the second bottom ram tips 15 in the second die cavities 33 are thus located underneath the surface of the die table 18. When passing into the transport device, the tablet 1 can therefore be moved into the cups by a simple rotational movement of the preferred turnstile 36. For this purpose, the turnstile 36 comprises two radially extending arms, whose shape and spacing is adjusted to the tablet size. The rotational frequency of the turnstile 36 is adjusted to the rotational speed of the die table 18, such that the tablets 1 are inserted into the cups 2 in a precisely timed manner.

FIG. 7 shows a schematic view of a preferred sorting station 26. The cups 2 with the pressed-in tablets 1, which preferably are cathodes, are preferably ejected by lifting the second bottom ram tips 15. Since the first bottom ram tips 14 are arranged on an inner pitch circle, they are located behind the cathodes in the direction of ejection. Due to the height-staggered rams, the first bottom ram tips 14 project from the surface of the die table 18 by at least the length difference $L_{D2}$ and thus do not obstruct the ejection of the cathodes. The ejection movement is dependent on the pressing force which was determined when the tablets were pressed in. If the pressing force is within the specified normal range, the cathodes are suitable. If the pressing force deviates from the specified normal range, the cathodes are rated defective. Defective, unsuitable cathodes are ejected when entering the sorting station on a first transport path **26*b* into a rejects container (not shown). Suitable cathodes are ejected at a slight delay in a second transport path 26*a*** of the discharge chute and placed in a container for suitable cathodes.

Figure 8:
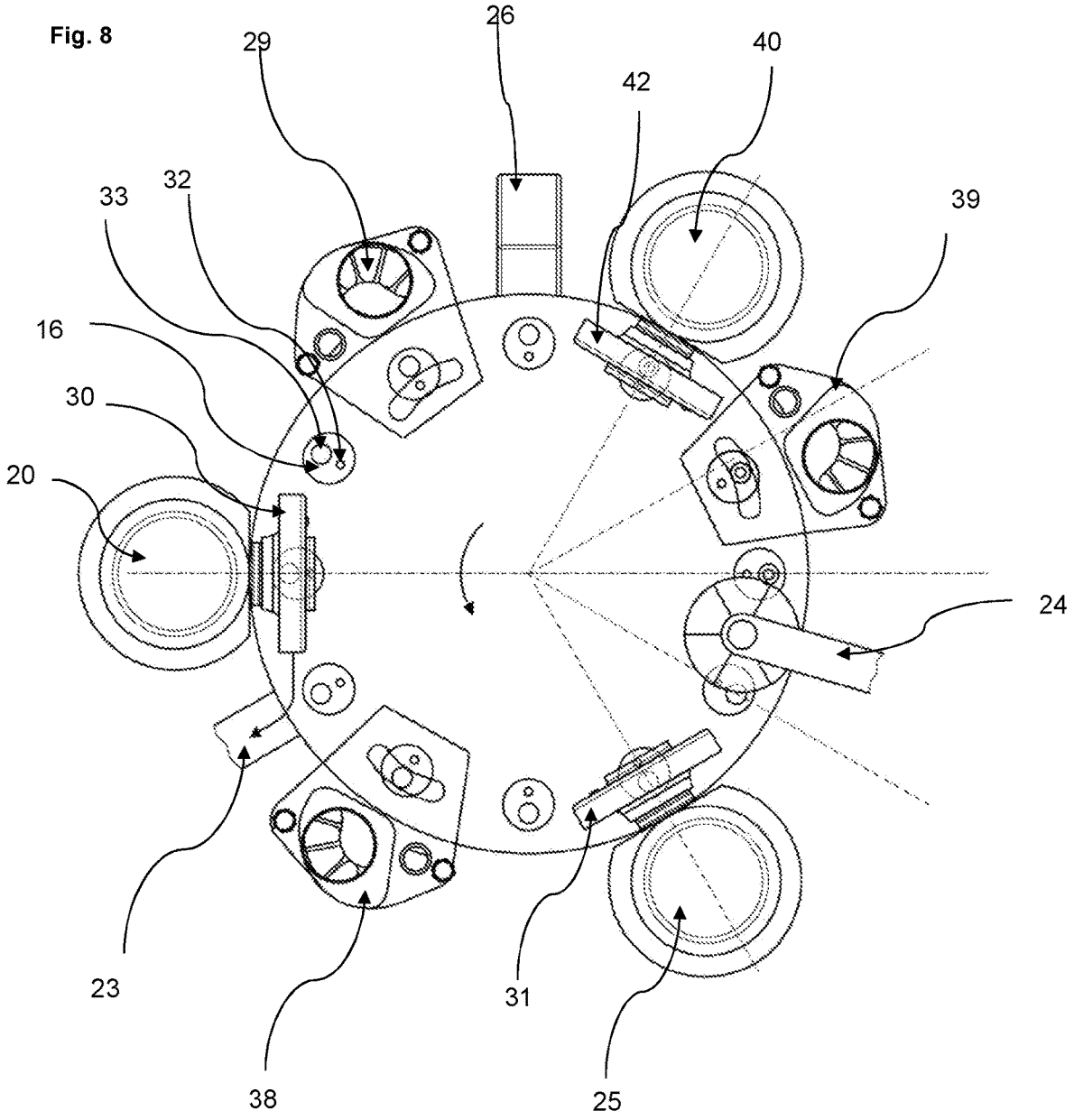

FIG. 8 shows a schematic representation of a preferred rotary press for producing coating-core tablets. The rotor 28 of the rotary press includes a top and a bottom ram guide 17 and 19, a die table 18, and height-staggered top and bottom rams 10 and 11 (all not drawn in). The direction of rotation of the rotor 28 is indicated by an arrow. During the rotation of the rotor, i.e. a rotation of the rotary press, the rams 10 and 11 rotate together with the die inserts 16 in the die table 18 through various functional assemblies, which enable the production process of the coating-core tablets. The assemblies of the rotary press are described in accordance with the flow of the production process along the direction of rotation of the rotor 28. Die inserts 16, each including a first die cavity 32 and a second die cavity 33, are present in recesses of the die table 18. The die cavities are preferably circular in shape, wherein the first die cavity 32 has a smaller diameter than the second die cavity 33. In addition, the first die cavities 32 are present on an inner pitch circle, while the second die cavities 33 are arranged on an outer pitch circle. By means of the first filling station 29, the first powder for the core 41 is filled into the first die cavities 32 of the die inserts. The powder is then pressed into a core tablet 41 in a first pressing operation while passing through the first pressing station 20. It is preferred for this purpose that top and bottom pressure rollers interact with the top and bottom rams in the pressing station 20. In this process, it is preferred that the pressing force is determined by means of a measuring cell in the pressing station 20 and compared to a normal range. A defective tablet would be detected via the pressing force check and be guided by the individual sorting system into the reject duct of the ejection station 23. The ejection station 23 preferably includes a discharge chute, and ejection is carried out by lifting the first bottom ram tips 14. After producing the core tablets 41, a second powder for the coating of the core tablets 41 is dosed into the second die cavities onto the surface area of the second bottom ram tips 15 by means of a second filling station 38. The second powder is tamped in the second pressing station by interaction of the top pressure roller 31 and the bottom pressure roller (not shown) with the rams. This process is preferably referred to as tamping. Slight tamping of the second powder for the coating allows particularly precise positioning of the core tablet 41. A transport device 24 is used for inserting the core tablets 41 onto the already tamped coating bottom in the second die cavities 33. The preferred transport device 24, which is shown in FIG. 6, is also preferably suited for inserting the core tablets 41. After the core tablets 41 were inserted onto the coating bottom in the second die cavities 33, additional metal powder, the second powder, is dosed by means of a third filling station 39. The core tablet 41 is thus completely encompassed by the coating powder. The coating-core tablet 43 is pressed in a third pressing operation by means of the third pressing station 40 and a top pressure roller 42 and a bottom pressure roller (not shown). It is preferred that the pressing force is determined during the third pressing operation. Suitable and unsuitable coating-core tablets are directed to different containers in a sorting station 26 by comparing the pressing force to a specified normal range. It is preferred that the sorting station 26 and mode of operation shown in FIG. 7 are used for this purpose.

Figure 9:
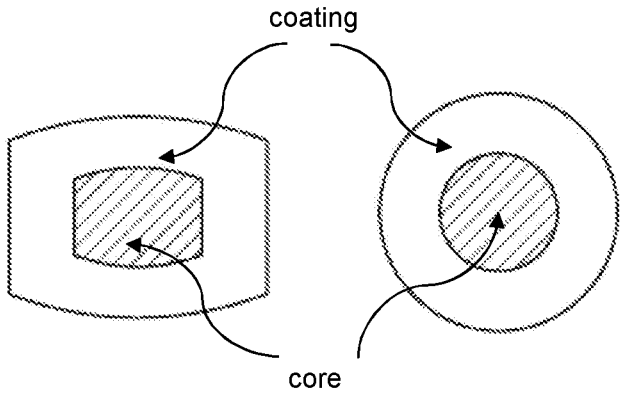
Figure 9:
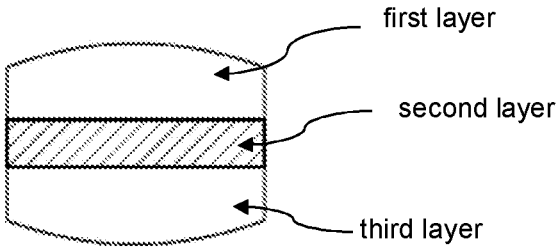
Figure 9:
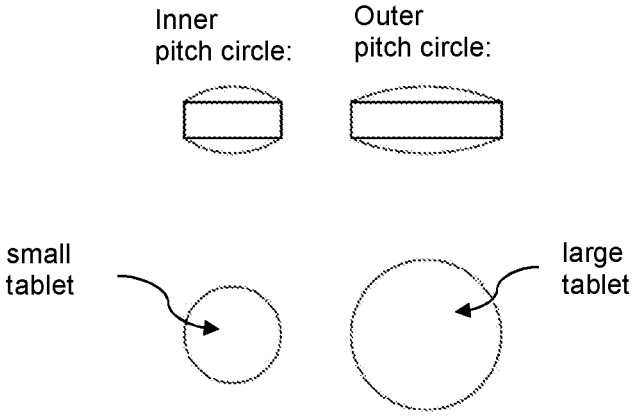
Figure 9:
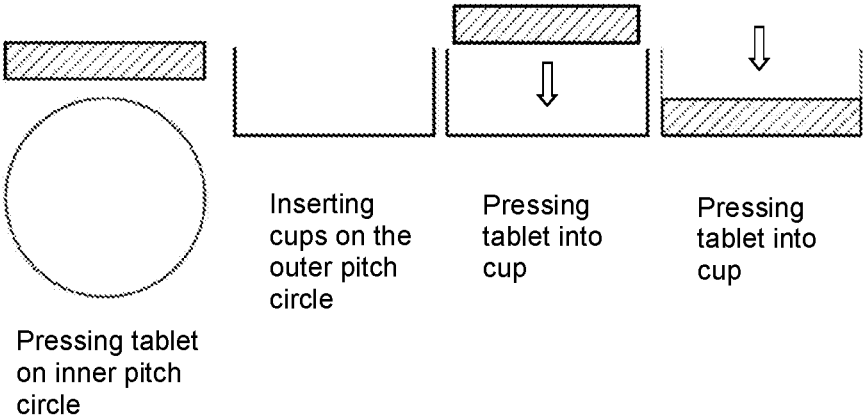

FIG. 9 illustrates various preferred fields of application of the rotary press having height-staggered rams according to the invention. Due to the height staggering of the rams, multiple pressing operations which may optionally build on one another can be carried out during one rotation. This allows the production of complex products during one rotation. A coating-core tablet can preferably be produced as described during one rotation. Furthermore, it is preferably possible to produce a multi-layer tablet, preferably a three-layer tablet, during one rotation of a single rotary press. For the production of the illustrated multi-layer tablet, the first and second die cavities are preferably circular, wherein the diameter of the first die cavities is only slightly smaller than the diameter of the second die cavities. It is preferred that the first die cavities are located on an inner pitch circle of the die table, whereas the second die cavities are located on an outer pitch circle. The powder of the inner second layer is preferably dosed into the first die cavities by means of a first filling station and then pressed into a tablet by means of a first pressing station. A second filling station then doses the material of the third layer into the second die cavities, which is pressed by means of a second pressing station. A transport device can place the tablet which forms the second layer of the multi-layer tablet into the second die cavities onto the already tamped third layer. A third filling station and pressing station preferably allow pressing on the first layer and thus finishing the multi-layer tablet. A has been explained in detail above, it is preferably further possible to press tablets into cups or other containers by means of the staggered rams according to the invention. The staggered rams thus surprisingly present a particularly simple manner of pressing products from multiple components during one rotation. Advantageously, first pressed products such as the core in the case of a coating-core tablet, a tablet which forms the second layer of a multi-layer tablet, or a metal oxide tablet for producing cathodes can processed further in pressing operations building on the first one. But the staggered rams can also be used for producing separate products in independent pressing operations. It can for example be preferred, as illustrated, to produce tablets of a smaller diameter in the first die cavities during the first half of the rotation and to produce tablets of a larger diameter in the second die cavities during the second half of the rotation. This makes it possible to produce tablets of different weight for the pharmaceutical industry using a single tablet in the rotation. For example, a batch of 50 mg tablets can be produced on the inner pitch circle in the first die cavities, while a batch of 100 mg tablets is run on the outer pitch circle in the second die cavities. It is preferred that the same material to be pressed with the same active ingredient is used for producing these tablets of different dosages. Compared to prior art, the staggered rams thus provide clearly increased flexibility with respect to the number or complexity of the pressed products.

It should be noted that various alternatives to the embodiments of the invention described can be used to execute the invention and to arrive at the solution according to the invention. Embodiments of the rotary press according to the invention and its use in the methods described are not restricted to the above preferred embodiments. Instead, a multitude of design variants is conceivable, which may deviate from the solution presented. It is the goal of the claims to define the scope of protection of the invention. The scope of protection as laid out in the claims is aimed at covering the rotary press according to the invention and preferred methods as well as equivalent embodiments thereof.

LIST OF REFERENCE SYMBOLS

1. tablet
1.1 bulk metal oxide tablet
1.2 pressed-in metal oxide tablet
2 cup
10 top ram
11 bottom ram
12 first top ram tip
13 second top ram tip
14 first bottom ram tip
15 second bottom ram tip
16 die insert
17 top ram guide
18 die table
19 bottom ram guide

20 first pressing station
21 cup feeding device
22 cup inserting station
23 ejection station for defective tablets
24 transport device
25 second pressing station
26 sorting station
26*a* transport path for suitable cathodes
26*b* transport path for unsuitable cathodes
27 mounting plate
28 rotor
29 first filling station
30 top pressure roller of the first pressing station
31 top pressure roller of the second pressing station
32 first die cavities
33 second die cavities
34 first material to be pressed/pressed product
35 second material to be pressed/pressed product
36 turnstile
37 recesses
38 second filling station
39 third filling station
40 third pressing station
41 core tablet
42 bottom pressure roller of the third pressing station
43 coating-core tablets
44 top ram shaft
45 bottom ram shaft

The invention claimed is:

1. A rotary press for carrying out at least two pressing operations during a rotation of the rotary press, said rotary press including a rotor (28), a die table (18), a top ram guide (17) for receiving top rams (10), and a bottom ram guide (19) for receiving bottom rams (11), characterized in that the top rams (10) each comprise at least two top ram tips (12, 13), wherein a first top ram tip (12) is of a length which is by a length difference ($L_{D1}$) shorter than that of a second top ram tip (13), and the bottom rams (11) each comprise at least two bottom ram tips (14, 15), wherein a first bottom ram tip (14) is of a length which is by a length difference ($L_{D2}$) longer than that of a second bottom ram tip (15), the die table (18) comprises first die cavities (32) which are aligned with the first top and bottom ram tips (12, 14), and comprises second die cavities (33), which are aligned with the second top and bottom ram tips (13, 15), such that a first material to be pressed (34) can be pressed in the first die cavities (32) in a first pressing operation and a second material to be pressed (35) can be pressed in the second die cavities (33) in a second pressing operation during one rotation of the rotor of the rotary press.

2. The rotary press according to the claim 1, characterized in that the extension of the first die cavities (32) and the extension of the first top and bottom ram tips (12, 14) are smaller than the extension of the second die cavities (33) and the extension of the second top and bottom ram tips (13, 15).

3. The rotary press according to claim 1, characterized in that the rotary press includes die inserts (16), the die table (18) comprises recesses (37) for the die inserts (16), and the first die cavity (32) and the second die cavity (33) are provided in a die insert (16).

4. The rotary press according to claim 1, characterized in that the rotary press includes a transport device (24), which transports the first pressed product (34) after the first pressing operation into the second die cavities (33).

5. The rotary press according to claim 4, characterized in that the transport device (24) includes a turnstile (36) or a slider, and the bottom press tool (11) can be moved after the first pressing operation to a position in which the upper end of the first bottom ram tip (14) is flush with the surface of the die table (18) and the first pressed product (34) is transported into the second die cavity (33) by turning the turnstile (36) or by the slider.

6. The rotary press according to claim 1, characterized in that the first die cavities (32) and the first top and bottom ram tips (12, 14) are arranged concentrically on an inner pitch circle, and the second die cavities (33) and the second top and bottom ram tips (13, 15) are arranged concentrically on an outer pitch circle.

7. The rotary press according to claim 1, characterized in that the rotary press is suitable for pressing tablets (1) in cups (2) and the rotary press includes a filling station (29), a first pressing station (20), a cup inserting station (22), a transport device (24), and a second pressing station (25), wherein the filling station (29) is configured to dose a powder, into the first die cavities (32), the first pressing station (20) is configured to press the powder in the first die cavities into a tablet (1) in a first pressing operation, the cup inserting station (22) is configured to position cups (2) in the second die cavities (33), the transport device (24) is configured to insert the tablet (1) into the cups (2), which are located in the second die cavities (33), and the second pressing station (25) is configured to press the tablet (1) into the cups (2) in a second pressing operation.

8. The rotary press according to claim 7, characterized in that the first pressing station (20) comprises a measuring device for determining the pressing force during the first pressing operation, and the rotary press includes an ejection station (23), which is configured to eject tablets (1) for which the pressing force deviates from a specified normal range during the pressing process.

9. The rotary press according to claim 7, characterized in that the second pressing station (25) comprises a measuring device for determining the pressing force during the second pressing operation, and the rotary press includes a sorting station (26), which is configured to direct cups (2) with pressed-in tablets (1) during the second pressing operation either to a transport path (26*a*) for suitable cups (2) with pressed-in tablets (1) or to a transport path (26*b*) for unsuitable cups (2) with pressed-in tablets (1) depending on the pressing force, if the pressing force deviates from a specified normal range.

10. The rotary press according to claim 7, characterized in that the pressing stations comprise top and bottom pressure rollers, which act on the rams (10, 11).

11. The rotary press according to claim 7, wherein the powder is a metal oxide powder.

12. A method for producing cathodes for button cells using a rotary press according to claim 1, the method comprising the following steps a) Dosing powder into first die cavities (32) by means of a filling station (29)

b) Pressing the powder into tablets (1) by means of a first pressing station (20), wherein optionally the pressing force is determined c) Optionally ejecting tablets (1) for which a pressing force was determined in step c) which deviates from a normal range, d) Inserting the cups (2) into the second die cavities (33) by means of a cup inserting station (22)

e) Inserting the tablet (1) into the cups (2), which are located in the second die cavities (33), by means of a transport device (24)

f) Pressing the tablet (1) into the bottom of the cups (2) by means of the second pressing station (25) and the interaction of the second top ram tips (13) and second bottom ram tips (15), wherein optionally the pressing force is determined g) Ejecting the cathodes, wherein optionally the cathodes are directed to a transport path (26*a*) for suitable cathodes or to a transport path (26*b*) for unsuitable cathodes depending on the pressing force determined in step f) by means of a sorting station (26).

13. The method for producing cathodes for button cells according to claim 12, wherein the dosing powder is a metal oxide powder.

14. The method for producing cathodes for button cells according to claim 12, wherein the transport device (24) includes a turnstile (36).

15. The method for producing cathodes for button cells according to claim 12, wherein the dosing powder is a metal oxide powder and the transport device (24) includes a turnstile (36).

16. The rotary press according to claim 1 for carrying out at least three pressing operations during one rotation of the rotary press characterized in that the rotary press is suitable for producing coating-core tablets (43) and the rotary press includes a filling station (29), a first pressing station (20), a second filling station (38), a second pressing station (25), a transport device (24), a third filling station (39), and a third pressing station (40), wherein the filling station (29) is configured to dose a first powder into the first die cavities (32), the first pressing station (20) is configured to press the first powder in the first die cavities (32) into a core tablet (41) in a first pressing operation, the second filling station (38) is configured to dose a second powder into the second die cavities (33), the second pressing station (25) is configured to tamp the second powder in the second die cavities (33) in a second pressing operation, the transport device (24) is configured to insert the core tablet (41) into the second die cavities (33) onto the already tamped second powder, the third filling station (39) is configured to dose the second powder into the second die cavities (33), whereby the core tablet (41) is covered by the second powder, the third pressing station (40) is configured to press the core tablet (41) coated with the second powder in the second die cavities (33) into a coating-core tablet (43).

17. The rotary press according to claim 16, characterized in that the first pressing station (20) comprises a measuring device for determining the pressing force during the first pressing operation, and the rotary press includes an ejection station (23), which is configured to eject core tablets (41) for which the pressing force deviates from a specified normal range during the pressing process.

18. The rotary press according to claim 16, characterized in that the third pressing station (40) comprises a measuring device for determining the pressing force during the third pressing operation, and the rotary press includes a sorting station (26), which is configured to guide coating-core tablets (43) during the third pressing operation to a transport path (26*a*) for suitable coating-core tablets (43) or to a transport path (26*b*) for unsuitable coating-core tablets (43) depending on the pressing force during the third pressing operation.

19. A method for producing coating-core tablets (43) using a rotary press according to claim 1, the method comprising the following steps a) Dosing a first powder for the core of the coating-core tablet (43) into first die cavities (32) by means of a first filling station (29)

b) Pressing the first powder into core tablets (41) by means of a first pressing station (20), wherein optionally the pressing force is determined c) Optionally ejecting core tablets (41) for which a pressing force was determined in step b) which deviates from a normal range d) Dosing a second powder for the coating of the coating-core tablet (43) into second die cavities (33) by means of a second filling station (38)

e) Tamping the second powder by means of a second pressing station (25)

f) Inserting the core tablet (41) into the tamped second powder, which is located in the second die cavities (33), by means of a transport device (24), g) Dosing the second powder into second die cavities (33) by means of a third filling station (39), such that the core tablet (41) is covered with the second powder h) Pressing the core tablet (41) coated with the second powder into a coating-core tablet (43) by means of a third pressing station (40), wherein optionally the pressing force is determined i) Ejecting the coating-core tablet (43), wherein optionally the coating-core tablets (43) are directed to a transport path (26*a*) for suitable coating-core tablets or to a transport path (26*b*) for unsuitable coating-core tablets depending on the pressing force determined in step h) by means of a sorting station (26).

20. The method for producing coating-core tablets according to claim 19, wherein the transport device (24) includes a turnstile (36).

* * * * *